US012342979B2

(12) United States Patent
Carter et al.

(10) Patent No.: US 12,342,979 B2
(45) **Date of Patent: *Jul. 1, 2025**

(54) ROBOTIC CLEANER WITH DUAL CLEANING ROLLERS

(71) Applicant: SHARKNINJA OPERATING LLC, Needham, MA (US)

(72) Inventors: Steven Paul Carter, London (GB); Adam Udy, Sutton (GB); Catriona A. Sutter, Brookline, MA (US); Christopher Pinches, Surrey (GB); David S. Clare, London (GB); Andre David Brown, Natick, MA (US); John Freese, Chestnut Hill, MA (US); Patrick Cleary, Allston, MA (US); Alexander J Calvino, Needham, MA (US); Lee Cottrell, Newton, MA (US); Daniel Meyer, Boston, MA (US); Daniel John Innes, West Roxbury, MA (US); David Jalbert, Needham, MA (US); Jason B. Thorne, Wellesley Hills, MA (US); Peter Hutchinson, Suzhou (CN); Gordon Howes, Suzhou (CN); Wenxiu Gao, Suzhou (CN); David Wu, Needham, MA (US); David W. Poirier, Lexington, MA (US); Daniel R. Der Marderosian, Westwood, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/519,793

(22) Filed: Nov. 27, 2023

(65) Prior Publication Data

US 2024/0090721 A1 Mar. 21, 2024

Related U.S. Application Data

(63) Continuation of application No. 17/556,992, filed on Dec. 20, 2021, now Pat. No. 11,839,346, which is a (Continued)

(51) Int. Cl.
*A47L 5/30* (2006.01)
*A47L 7/00* (2006.01)
(Continued)

(52) U.S. Cl.
CPC ..... *A47L 9/0613* (2013.01); *A47L 5/30* (2013.01); *A47L 9/0477* (2013.01);
(Continued)

(58) Field of Classification Search
CPC ..... A47L 9/0613; A47L 5/30; A47L 9/0477; A47L 9/0488; A47L 7/0066;
(Continued)

(56) References Cited

U.S. PATENT DOCUMENTS 1,642,518 A 9/1927 Throop
1,706,039 A 3/1929 Owen
(Continued)

FOREIGN PATENT DOCUMENTS

CA 2178202 4/1996
CN 201469183 5/2010
(Continued)

OTHER PUBLICATIONS

US 8,359,703 B2, 01/2013, Svendsen et al. (withdrawn)
(Continued)

*Primary Examiner* — David Redding
(74) *Attorney, Agent, or Firm* — Grossman Tucker Perreault & Pfleger, PLLC

(57) ABSTRACT

A robotic cleaner includes a housing, a suction conduit with an opening, and a leading roller mounted in front of a brush
(Continued)

roll. An inter-roller air passageway may be defined between the leading roller and the brush roll wherein the lower portion of the leading roller is exposed to a flow path to the suction conduit and an upper portion of the leading roller is outside of the flow path. Optionally, a combing unit includes a plurality of combing protrusions extending into the leading roller and having leading edges not aligned with a center of the leading roller. Optionally, a sealing strip is located along a rear side of the opening and along a portion of left and right sides of the opening. The underside may define side edge vacuum passageways extending from the sides of the housing partially between the leading roller and the sealing strip towards the opening.

19 Claims, 5 Drawing Sheets

Related U.S. Application Data continuation of application No. 15/987,589, filed on May 23, 2018, now Pat. No. 11,202,542.

(60) Provisional application No. 62/511,099, filed on May 25, 2017.

(51) Int. Cl.
*A47L 9/04* (2006.01)
*A47L 9/06* (2006.01)

(52) U.S. Cl.
CPC ..... *A47L 9/0488* (2013.01); *A47L 7/0066* (2013.01); *A47L 2201/00* (2013.01)

(58) Field of Classification Search
CPC .. A47L 2201/00; A47L 11/24; A47L 11/4002; A47L 11/4011; A47L 11/4036; A47L 11/4041; A47L 11/4061; A47L 11/4094
See application file for complete search history.

(56) References Cited

U.S. PATENT DOCUMENTS 2,032,345 A 3/1936 Cranon
2,089,600 A 8/1937 Edwards
2,241,775 A 5/1941 Forsberg
2,411,488 A 11/1946 White
2,607,062 A 8/1952 Le Febvre et al.
2,707,792 A 5/1955 Waller
2,785,431 A 3/1957 Pardee
2,869,170 A 1/1959 Wessel
3,319,278 A 5/1967 Frazer
3,643,282 A 2/1972 Lechene
4,138,762 A 2/1979 Jost et al.
4,173,807 A 11/1979 Maier
4,333,205 A 6/1982 Woodward et al.
4,334,337 A 6/1982 Miller et al.
4,372,004 A 2/1983 Vermillion
4,384,386 A 5/1983 Dorner et al.
4,403,372 A 9/1983 Keane et al.
4,475,265 A 10/1984 Berfield
4,627,127 A 12/1986 Dupre
4,662,027 A 5/1987 Parker et al.
4,912,805 A 4/1990 Krasznai et al.
5,014,387 A 5/1991 Hays
5,272,785 A 12/1993 Stegens
5,309,592 A 5/1994 Hiratsuka
D348,548 S 7/1994 Pino
5,341,540 A 8/1994 Soupert et al.
5,373,603 A 12/1994 Stegens
5,452,490 A 9/1995 Brundula et al.
5,465,451 A 11/1995 Stegens
5,495,634 A 3/1996 Brundula et al.
5,611,109 A 3/1997 Worwag
5,613,261 A 3/1997 Kawakami et al.
5,632,060 A 5/1997 Steinberg et al.
5,634,239 A 6/1997 Tuvin et al.
5,765,258 A 6/1998 Melito et al.
5,781,960 A 7/1998 Kilström
5,815,880 A 10/1998 Nakanishi
5,867,800 A 2/1999 Leif
5,890,250 A 4/1999 Lange et al.
5,903,124 A 5/1999 Kawakami
5,940,927 A 8/1999 Haegermarck et al.
5,960,514 A 10/1999 Miller et al.
6,012,200 A 1/2000 Murphy et al.
6,161,245 A 12/2000 Weihrauch
D440,019 S 4/2001 Mehaffey et al.
6,226,832 B1 5/2001 McCormick
6,237,188 B1 5/2001 Takemoto et al.
6,314,611 B1 11/2001 Sauers
6,324,714 B1 12/2001 Walz et al.
6,367,781 B1 4/2002 Flynn et al.
D473,687 S 4/2003 Kaffenberger
6,550,099 B2 4/2003 Worwag
6,591,441 B2 7/2003 Stegens et al.
6,810,559 B2 11/2004 Mertes et al.
6,883,201 B2 4/2005 Jones et al.
6,971,140 B2 12/2005 Kim
7,013,528 B2 3/2006 Parker et al.
D524,498 S 7/2006 Luebbering et al.
7,079,923 B2 7/2006 Abramson et al.
7,152,267 B2 12/2006 Kaleta
7,171,723 B2 2/2007 Kobayashi et al.
7,185,396 B2 3/2007 Im et al.
7,200,893 B2 4/2007 Gerber et al.
7,243,393 B2 7/2007 Matusz et al.
7,316,050 B2 1/2008 Worwag
7,328,479 B2 2/2008 Willenbring
7,329,294 B2 2/2008 Conrad
D566,356 S 4/2008 Medema
D569,564 S 5/2008 Labarbera
7,448,113 B2 11/2008 Jones et al.
D594,612 S 6/2009 Umeda
D597,268 S 7/2009 Santiago et al.
7,571,511 B2 8/2009 Jones et al.
7,636,982 B2 12/2009 Jones et al.
7,690,079 B2 4/2010 Boddy et al.
D619,315 S 7/2010 Ayers
7,769,490 B2 8/2010 Abramson et al.
D635,728 S 4/2011 Fjellman
7,979,952 B2 7/2011 Beskow et al.
8,011,050 B2 9/2011 Knopow
8,032,985 B2 10/2011 Seo
8,037,571 B2 10/2011 Butts et al.
8,087,117 B2 1/2012 Kapoor et al.
8,117,714 B2 2/2012 Nguyen et al.
D655,468 S 3/2012 Karsan
8,239,992 B2 8/2012 Schnittman et al.
8,250,704 B2 8/2012 Yoo
D668,010 S 9/2012 Stickney et al.
8,316,503 B2 11/2012 Follows et al.
8,347,444 B2 1/2013 Schnittman et al.
8,370,985 B2 2/2013 Schnittman et al.
8,402,600 B2 3/2013 Beskow et al.
8,402,601 B2 3/2013 Fahlström
D681,291 S 4/2013 Morgan et al.
8,418,303 B2 4/2013 Kapoor et al.
8,438,695 B2 5/2013 Gilbert, Jr. et al.
8,443,477 B2 5/2013 Jang et al.
8,474,090 B2 7/2013 Jones et al.
8,516,651 B2 8/2013 Jones et al.
8,631,541 B2 1/2014 Tran
8,646,984 B2 2/2014 Gagnon
8,656,544 B1 2/2014 Anderson
8,656,550 B2 2/2014 Jones et al.
8,661,605 B2 3/2014 Svendsen et al.
8,671,507 B2 3/2014 Jones et al.
8,695,144 B2 4/2014 Jang et al.
8,720,001 B2 5/2014 Courtney et al.
8,726,441 B1 5/2014 Colasanti et al.
8,741,013 B2 6/2014 Swett et al.

(56) References Cited

U.S. PATENT DOCUMENTS 8,744,628 B2 6/2014 Tang
8,745,818 B2 6/2014 Jean-Paul et al.
8,763,199 B2 7/2014 Jones et al.
8,776,311 B2 7/2014 Genn et al.
8,782,851 B2 7/2014 Follows et al.
8,800,107 B2 8/2014 Blouin
8,806,710 B2 8/2014 Follows et al.
8,826,493 B2 9/2014 Stegens
8,832,902 B2 9/2014 Kim et al.
8,839,477 B2 9/2014 Schnittman et al.
8,862,271 B2 10/2014 Shamlian et al.
8,881,339 B2 11/2014 Gilbert, Jr. et al.
D720,104 S 12/2014 Santiago et al.
8,910,342 B2 12/2014 Gilbert, Jr. et al.
8,950,792 B2 2/2015 Hickey et al.
8,955,192 B2 2/2015 Gilbert, Jr. et al.
9,004,553 B2 4/2015 Hickey et al.
9,010,882 B2 4/2015 Romanov et al.
9,021,655 B2 5/2015 Owen et al.
9,027,198 B2 5/2015 Conrad
9,038,233 B2 5/2015 Jones et al.
D731,130 S 6/2015 Dyson et al.
D731,134 S 6/2015 Dyson et al.
D731,136 S 6/2015 Yun et al.
D731,720 S 6/2015 Gidwell et al.
D731,724 S 6/2015 Cheon et al.
9,066,640 B2 6/2015 Iles et al.
D738,583 S 9/2015 Gidwell et al.
D738,584 S 9/2015 Niedzwecki
9,144,355 B2 9/2015 Jang et al.
9,144,356 B2 9/2015 Yun
D741,558 S 10/2015 Kerr
D742,083 S 10/2015 Gidwell et al.
9,149,170 B2 10/2015 Ozick et al.
9,167,946 B2 10/2015 Jones et al.
D743,123 S 11/2015 Chu
D745,231 S 12/2015 Niedzwecki
9,211,045 B2 12/2015 Li et al.
D747,571 S 1/2016 Dyson
D747,572 S 1/2016 Kerr
9,295,362 B2 3/2016 Eriksson
9,314,140 B2 4/2016 Eriksson
9,320,398 B2 4/2016 Hussey et al.
9,320,400 B2 4/2016 Gilbert, Jr. et al.
9,326,654 B2 5/2016 Doughty
9,346,426 B2 5/2016 Hickey et al.
D761,507 S 7/2016 Heck et al.
D762,031 S 7/2016 Niedzwecki
9,392,921 B2 7/2016 Baek et al.
9,442,488 B2 9/2016 Shamlian et al.
9,451,853 B2 9/2016 Conrad et al.
D770,111 S 10/2016 Lee et al.
9,456,723 B2 10/2016 Thorne et al.
9,468,346 B1 10/2016 Rzepka
D771,890 S 11/2016 Kim
D772,512 S 11/2016 Yoon et al.
D773,139 S 11/2016 Palladino
9,480,374 B2 11/2016 Li et al.
9,480,381 B2 11/2016 Schnittman et al.
9,483,055 B2 11/2016 Johnson et al.
D774,260 S 12/2016 Manning
D774,264 S 12/2016 Bartram et al.
D779,751 S 2/2017 Chu
D779,752 S 2/2017 Johnson
D781,014 S 3/2017 Wu et al.
9,591,959 B2 3/2017 Landry et al.
D788,383 S 5/2017 Donegan et al.
9,648,999 B2 5/2017 Uphoff et al.
9,661,971 B2 5/2017 Riehl
D789,007 S 6/2017 Jang et al.
D790,785 S 6/2017 Courtney et al.
D792,665 S 7/2017 Salagnac
D796,134 S 8/2017 LaBarbera
D796,136 S 8/2017 Reynolds et al.
9,839,335 B2 12/2017 Eriksson
9,848,746 B2 12/2017 Feng
9,949,605 B2 4/2018 Isley et al.
10,423,160 B2 9/2019 Tang
11,202,542 B2 * 12/2021 Carter ..... A47L 5/30
11,759,069 B2 9/2023 Gacin et al.
11,839,346 B2 * 12/2023 Carter ..... A47L 9/0477
2002/0124334 A1 9/2002 Worwag
2003/0106183 A1 6/2003 Frederick et al.
2003/0145424 A1 8/2003 Stephens et al.
2003/0159240 A1 8/2003 Mertes et al.
2004/0045125 A1 3/2004 Park et al.
2005/0166356 A1 8/2005 Uehigashi
2005/0172447 A1 8/2005 Roney et al.
2006/0037170 A1 2/2006 Shimizu
2006/0042042 A1 3/2006 Mertes et al.
2006/0191097 A1 8/2006 Baumhakel
2006/0293794 A1 12/2006 Harwig et al.
2007/0261193 A1 11/2007 Gordon et al.
2008/0052846 A1 3/2008 Kapoor et al.
2009/0000057 A1 1/2009 Yoo et al.
2009/0229075 A1 9/2009 Eriksson
2010/0107359 A1 5/2010 Yoo
2010/0205768 A1 8/2010 Oh
2010/0287717 A1 11/2010 Jang et al.
2010/0306958 A1 12/2010 Follows et al.
2011/0219571 A1 9/2011 Dyson et al.
2011/0296648 A1 12/2011 Kah, Jr.
2012/0000030 A1 1/2012 Conrad
2012/0011676 A1 1/2012 Jung et al.
2012/0169497 A1 7/2012 Schnittman et al.
2012/0198644 A1 8/2012 Iles
2012/0311802 A1 12/2012 Hinnant
2012/0311813 A1 12/2012 Duane, Jr. et al.
2013/0058635 A1 3/2013 Vrdoljak
2013/0139349 A1 6/2013 Iles et al.
2013/0152337 A1 6/2013 Thorne
2013/0205520 A1 8/2013 Kapoor et al.
2013/0212831 A1 8/2013 Follows et al.
2013/0298350 A1 11/2013 Schnittman et al.
2014/0060577 A1 3/2014 Bruders et al.
2014/0150201 A1 6/2014 McGee et al.
2014/0150202 A1 6/2014 Schultheis
2014/0196247 A1 7/2014 Kasper
2014/0237760 A1 8/2014 Conrad
2014/0259475 A1 9/2014 Doughty
2014/0259521 A1 9/2014 Kowalski
2014/0317879 A1 10/2014 Blouin
2015/0013102 A1 1/2015 Bilger
2015/0033498 A1 2/2015 McVey
2015/0040340 A1 2/2015 Bilger et al.
2015/0135474 A1 5/2015 Gidwell
2015/0289735 A1 10/2015 Van Der Kooi et al.
2015/0297054 A1 10/2015 Weeks et al.
2015/0351596 A1 12/2015 Thorne
2015/0359396 A1 12/2015 Yun
2016/0058257 A1 3/2016 Ventress et al.
2016/0113469 A1 4/2016 Schnittman et al.
2016/0128530 A1 5/2016 Thorne et al.
2016/0166127 A1 6/2016 Lewis
2016/0174793 A1 6/2016 Burke et al.
2016/0183749 A1 6/2016 Isley et al.
2016/0213217 A1 7/2016 Doughty
2016/0220080 A1 8/2016 Thorne
2016/0220081 A1 8/2016 Xu et al.
2016/0220082 A1 8/2016 Thorne et al.
2016/0324388 A1 11/2016 Vrdoljak et al.
2016/0345792 A1 12/2016 Herron et al.
2016/0345795 A1 12/2016 Manning
2016/0374533 A1 12/2016 Innes et al.
2017/0042319 A1 2/2017 Conrad et al.
2017/0079493 A1 3/2017 Genn et al.
2017/0112343 A1 4/2017 Innes et al.
2017/0127896 A1 5/2017 Carter et al.
2017/0144810 A1 5/2017 Birdsell
2017/0172363 A1 6/2017 Eriksson et al.
2017/0209008 A1 7/2017 Isley et al.
2017/0215667 A1 8/2017 Thorne et al.
2017/0231445 A1 8/2017 Kasper
2017/0280957 A1 10/2017 Jeong et al.

(56) References Cited

U.S. PATENT DOCUMENTS

| | | | |
|---|---|---|---|
| 2017/0332859 | A1 | 11/2017 | Nam et al. |
| 2017/0347848 | A1 | 12/2017 | Carter et al. |
| 2018/0035854 | A1 | 2/2018 | Thorne |
| 2018/0064301 | A1 | 3/2018 | Cottrell et al. |
| 2018/0068815 | A1 | 3/2018 | Cottrell |
| 2018/0070785 | A1 | 3/2018 | Udy et al. |
| 2018/0199784 | A1 | 7/2018 | Schnittman et al. |
| 2018/0255991 | A1 | 9/2018 | Der Marderosian et al. |
| 2018/0296046 | A1 | 10/2018 | Thorne et al. |
| 2018/0306432 | A1 | 10/2018 | Ognjen et al. |
| 2018/0325252 | A1 | 11/2018 | Hopke et al. |
| 2018/0338654 | A1 | 11/2018 | Kelsey |
| 2018/0338656 | A1 | 11/2018 | Carter et al. |
| 2019/0038098 | A1 | 2/2019 | Thorne et al. |
| 2019/0059668 | A1 | 2/2019 | Thorne et al. |
| 2019/0069740 | A1 | 3/2019 | Thorne et al. |
| 2019/0069744 | A1 | 3/2019 | Liggett et al. |
| 2019/0090701 | A1 | 3/2019 | Tonderys et al. |
| 2019/0090705 | A1 | 3/2019 | Thorne et al. |
| 2019/0191947 | A1 | 6/2019 | Freese et al. |
| 2019/0193120 | A1 | 6/2019 | Brown et al. |
| 2019/0246853 | A1 | 8/2019 | Sardar et al. |
| 2019/0274500 | A1 | 9/2019 | Thorne et al. |
| 2019/0274501 | A1 | 9/2019 | Antonisami et al. |
| 2019/0298123 | A1 | 10/2019 | Conrad et al. |
| 2019/0302793 | A1 | 10/2019 | Leech et al. |
| 2019/0307302 | A1 | 10/2019 | Zheng et al. |
| 2019/0320865 | A1 | 10/2019 | Brown et al. |
| 2019/0320866 | A1 | 10/2019 | Thorne et al. |
| 2019/0335968 | A1 | 11/2019 | Harting et al. |
| 2019/0343349 | A1 | 11/2019 | Clare et al. |
| 2019/0357740 | A1 | 11/2019 | Thorne et al. |
| 2020/0000298 | A1 | 1/2020 | Brown et al. |
| 2020/0022543 | A1 | 1/2020 | Gill et al. |
| 2020/0022544 | A1 | 1/2020 | Gill et al. |
| 2020/0022553 | A1 | 1/2020 | Gill et al. |
| 2020/0037833 | A1 | 2/2020 | Niedzwecki et al. |
| 2020/0037843 | A1 | 2/2020 | Fiebig et al. |
| 2020/0046184 | A1 | 2/2020 | Freese et al. |
| 2020/0077855 | A1 | 3/2020 | Brown et al. |
| 2020/0085267 | A1 | 3/2020 | Thorne et al. |
| 2020/0085269 | A1 | 3/2020 | Thorne |
| 2020/0121144 | A1 | 4/2020 | Gacin et al. |
| 2020/0121148 | A1 | 4/2020 | Hoffman et al. |
| 2020/0138260 | A1 | 5/2020 | Sutter et al. |
| 2020/0166949 | A1 | 5/2020 | Leech et al. |
| 2020/0170470 | A1 | 6/2020 | Liggett et al. |
| 2020/0201348 | A1 | 6/2020 | Leech |
| 2020/0205631 | A1 | 7/2020 | Brown et al. |
| 2020/0205634 | A1 | 7/2020 | Sutter et al. |
| 2020/0237171 | A1 | 7/2020 | Xu et al. |
| 2020/0275812 | A1 | 9/2020 | Burbank et al. |
| 2020/0288929 | A1 | 9/2020 | Brunner |
| 2020/0288930 | A1 | 9/2020 | Wells |
| 2020/0297172 | A1 | 9/2020 | Tonderys et al. |
| 2020/0301430 | A1 | 9/2020 | Irkliy et al. |
| 2020/0315418 | A1 | 10/2020 | Howard et al. |
| 2020/0345196 | A1 | 11/2020 | Innes et al. |
| 2020/0367711 | A1 | 11/2020 | Thorne et al. |
| 2020/0371526 | A1 | 11/2020 | Kamada |
| 2020/0383547 | A1 | 12/2020 | Sutter et al. |
| 2021/0007569 | A1 | 1/2021 | Howard et al. |
| 2021/0022574 | A1 | 1/2021 | Harting |
| 2021/0030227 | A1 | 2/2021 | Mathieu et al. |
| 2021/0038032 | A1 | 2/2021 | Brown |
| 2021/0059495 | A1 | 3/2021 | Gill et al. |
| 2021/0085144 | A1 | 3/2021 | Woodrow et al. |
| 2021/0169289 | A1 | 6/2021 | Thorne et al. |
| 2021/0175772 | A1 | 6/2021 | Aini |
| 2021/0177223 | A1 | 6/2021 | Der Marderosian et al. |
| 2021/0186282 | A1 | 6/2021 | Mathieu et al. |
| 2021/0254615 | A1 | 8/2021 | Burbank |
| 2021/0307581 | A1 | 10/2021 | Thorne et al. |
| 2022/0071459 | A1 | 3/2022 | Gacin et al. |
| 2022/0095864 | A1 | 3/2022 | Guoqing |
| 2023/0248192 | A1 | 8/2023 | Brown et al. |

FOREIGN PATENT DOCUMENTS

| | | | |
|---|---|---|---|
| CN | 201573207 | | 9/2010 |
| CN | 201573208 | | 9/2010 |
| CN | 201602713 | | 10/2010 |
| CN | 201755197 | | 3/2011 |
| CN | 201861563 | | 6/2011 |
| CN | 102188197 | | 9/2011 |
| CN | 101375781 | | 11/2011 |
| CN | 202141815 | | 2/2012 |
| CN | 102727136 | | 10/2012 |
| CN | 102039595 | | 2/2013 |
| CN | 102218740 | | 3/2014 |
| CN | 203662686 | | 6/2014 |
| CN | 104138238 | | 11/2014 |
| CN | 204016183 | | 12/2014 |
| CN | 204074580 | | 1/2015 |
| CN | 104605789 | | 5/2015 |
| CN | 104703525 | | 6/2015 |
| CN | 104750105 | | 7/2015 |
| CN | 104977926 | | 10/2015 |
| CN | 102866433 | | 11/2015 |
| CN | 205181249 | | 4/2016 |
| CN | 205620809 | | 10/2016 |
| CN | 104216404 | | 2/2017 |
| CN | 206080407 | | 4/2017 |
| CN | 106963290 | | 7/2017 |
| CN | 206403708 | | 8/2017 |
| CN | 206860741 | | 1/2018 |
| CN | 104224054 | | 3/2018 |
| CN | 107788913 | | 3/2018 |
| DE | 19544999 | | 6/1997 |
| DE | 19615712 | | 12/1997 |
| DE | 10242257 | | 4/2003 |
| DE | 10302525 | | 10/2006 |
| DE | 102010017211 | | 12/2011 |
| DE | 102010017211 | A1 | 12/2011 |
| DE | 102010017258 | | 12/2011 |
| DE | 102010017258 | A1 | 12/2011 |
| DE | 102012207357 | | 11/2013 |
| EP | 0042370 | | 12/1981 |
| EP | 0584888 | | 3/1994 |
| EP | 0909547 | | 4/1999 |
| EP | 0753160 | | 4/2001 |
| EP | 1994869 | | 11/2008 |
| EP | 2289381 | | 3/2011 |
| EP | 2218385 | | 3/2013 |
| EP | 2543301 | | 9/2013 |
| EP | 2941994 | | 11/2015 |
| EP | 3073881 | | 10/2016 |
| EP | 3187083 | | 7/2017 |
| EP | 3007023 | | 11/2018 |
| GB | 338414 | | 11/1930 |
| GB | 360577 | | 11/1931 |
| GB | 516291 | | 12/1939 |
| GB | 583738 | | 12/1946 |
| GB | 877778 | | 9/1961 |
| GB | 1109783 | | 4/1968 |
| GB | 1403860 | | 8/1975 |
| GB | 2109224 | | 6/1983 |
| GB | 228577 | | 7/1995 |
| GB | 2476810 | | 7/2011 |
| GB | 2476811 | | 7/2011 |
| GB | 2476812 | | 7/2011 |
| GB | 2509925 | | 7/2014 |
| GB | 2529819 | | 3/2016 |
| JP | S507359 | | 1/1975 |
| JP | S58221925 | | 12/1983 |
| JP | S59174143 | U | 11/1984 |
| JP | 03228721 | A | 10/1991 |
| JP | 05228083 | A | 9/1993 |
| JP | H06284991 | A | 10/1994 |
| JP | H07322981 | | 12/1995 |
| JP | H0889455 | | 4/1996 |
| JP | 2639155 | B2 | 8/1997 |

(56) References Cited

FOREIGN PATENT DOCUMENTS

| | | | |
|---|---|---|---|
| JP | H09206258 | | 8/1997 |
| JP | H10127542 | | 5/1998 |
| JP | H10201682 | | 8/1998 |
| JP | H11028178 | | 2/1999 |
| JP | H11028178 | A | 2/1999 |
| JP | H11187997 | | 7/1999 |
| JP | 2000033059 | A | 2/2000 |
| JP | 2000139786 | | 5/2000 |
| JP | 2000166826 | | 6/2000 |
| JP | 2001120473 | | 5/2001 |
| JP | 2003339589 | | 12/2003 |
| JP | 2004097264 | | 4/2004 |
| JP | 2004222912 | | 8/2004 |
| JP | 2004222912 | A | 8/2004 |
| JP | 2005046262 | A | 2/2005 |
| JP | 3660042 | | 6/2005 |
| JP | 2006247229 | | 9/2006 |
| JP | 2006312066 | | 11/2006 |
| JP | 2006312066 | A | 11/2006 |
| JP | 2007068835 | | 3/2007 |
| JP | 2008000382 | | 1/2008 |
| JP | 2008043351 | | 2/2008 |
| JP | 2009045503 | | 3/2009 |
| JP | 2010063624 | | 3/2010 |
| JP | 2010246848 | | 11/2010 |
| JP | 2011050428 | | 3/2011 |
| JP | 2011188951 | | 9/2011 |
| JP | 2013013590 | A | 1/2013 |
| JP | 2013052238 | A | 3/2013 |
| JP | 2013516261 | | 5/2013 |
| JP | 2014033738 | A | 2/2014 |
| JP | 2014509211 | A | 4/2014 |
| JP | 2014087385 | | 5/2014 |
| JP | 2015000210 | | 1/2015 |
| JP | 2015116414 | | 6/2015 |
| JP | 2016504100 | A | 2/2016 |
| JP | 2017074258 | | 4/2017 |
| JP | 2017121468 | A | 7/2017 |
| KR | 19940006561 | | 7/1994 |
| KR | 950026477 | | 10/1995 |
| KR | 20040052092 | A | 6/2004 |
| KR | 20050099416 | | 10/2005 |
| KR | 100593324 | B1 | 6/2006 |
| KR | 100638220 | | 10/2006 |
| KR | 20070031015 | | 3/2007 |
| KR | 20070101479 | | 10/2007 |
| KR | 20090098513 | | 9/2009 |
| WO | 9210967 | A1 | 7/1992 |
| WO | 199210967 | | 7/1992 |
| WO | 2000078198 | | 12/2000 |
| WO | 0141618 | | 6/2001 |
| WO | 2002062194 | | 8/2002 |
| WO | 2003024292 | | 3/2003 |
| WO | 2005111084 | | 11/2005 |
| WO | 2009117383 | | 9/2009 |
| WO | 2011083294 | | 7/2011 |
| WO | 2013104886 | | 7/2013 |
| WO | 2014131105 | | 9/2014 |
| WO | 2014131106 | | 9/2014 |
| WO | 2014177216 | | 11/2014 |
| WO | 2015015165 | | 2/2015 |
| WO | 2015015166 | | 2/2015 |
| WO | 2015015167 | | 2/2015 |
| WO | 2015075481 | | 5/2015 |
| WO | 2016034848 | | 3/2016 |
| WO | 2017070492 | A1 | 4/2017 |
| WO | 2019139846 | | 7/2019 |

OTHER PUBLICATIONS

US Office Action issued Feb. 27, 2024, received in U.S. Appl. No. 18/225,138, 9 pages.
Extended European Search Report issued Apr. 2, 2024, received in European Patent Application No. 21865202.2, 9 pages.
U.S. Appl. No. 60/747,791, filed May 19, 2006.
CPU-Zilla, Electrolux Trilobite—Final Words, Hardware Zone.com, Jimmy Tang, Mar. 25, 2003, 2 pages.
CPU-Zilla, Electrolux Trilobite—Lifes Better With Auto-Vacumming, Hardware Zone.com, Jimmy Tang, Mar. 25, 2003, 3 pages.
The Electrolux Group, Trilobite Manual, Sep. 28, 2001, 10 pages.
CPU-Zilla, Electrolux Trilobite—Things to Consider, Hardware Zone.com, Jimmy Tang, Mar. 25, 2003, 3 pages.
CPU-Zilla, Electrolux Trilobite—Welcome to Paleozoic Park . . . Not Quite, Hardware Zone.com, Jimmy Tang, Mar. 25, 2003, 2 pages.
Beforemario, Nintendo Chiritori, Mar. 13, 2011, 6 pages.
Chinese Office Action with English translation, issued May 22, 2020, received in China Applicatin No. 201810965394.2, 20 pgs.
Chinese Office Action with English translation, issued May 26, 2020, received in China Application No. 201810516731.X, 13 pgs.
Korean Office Action with English translation, issued Aug. 31, 2020, received in Korean Application No. 10-2020-7018384, 7 pgs.
Chinese Office Action with English translation, issued Oct. 15, 2020, received in China Application No. 201610921399.6, 21 pgs.
Australian Examination Report issued Jun. 11, 2020, received in Australian Application No. 2019246800, 7 pgs.
European Search Report issued Nov. 27, 2020, received in EP Application No. 18806820.9, 7 pgs.
US Office Action issued Sep. 1, 2020, received in U.S. Appl. No. 15/492,320, 14 pgs.
US Office Action issued May 21, 2020, received in U.S. Appl. No. 15/331,045, 14 pgs.
Japanese Office Action with English translation, issued Jan. 21, 2021, received in JP Application No. 2017-557189, 27 pgs.
Extended European Search Report dated Jun. 17, 2022, received in European Patent Application No. 19872356.1, 6 pages.
Chinese Office Action with English Machine Translation dated Jun. 28, 2022, received in Chinese Patent Application No. 202111186082.X, 14 pages.
Chinese Office Action with English Translation issued Jun. 24, 2022, received in Chinese Patent Application No. 2019800688188, 16 pages.
Korean Office Action with English Machine Translation dated Aug. 1, 2022, received in Korean Patent Application No. 10-2021-7014906, 12 pages.
US Office Action issued Aug. 10, 2022, received in U.S. Appl. No. 15/492,320, 15 pages.
Chinese Office Action with English Machine Translation issued Aug. 10, 2022, received in Chinese Patent Application No. 202110712842.X, 20 pages.
Canadian Office Action issued Jul. 25, 2022, received in Canadian Patent Application No. 3,117,040, 3 pages.
Chinese Office Action with English translation issued Feb. 18, 2022, received in Chinese Application No. 202110712842.X, 13 pages.
UK Examination Report issued Mar. 30, 2022, received in UK Application No. GB191515.4, 5 pages.
Australian Examination Report issued Mar. 17, 2022, received in Australian Application No. 2019362030, 3 pages.
Japanese Office Action with English translation issued Apr. 22, 2022, received in Japanese Application No. 2021-521415, 13 pages.
UK Examination Report issued Sep. 20, 2022, received in UK Patent Application No. 1915155.4, 4 pages.
UK Examination Report issued Oct. 24, 2022, received in UK Patent Application No. 2212062.0, 4 pages.
US Office Action issued Oct. 20, 2022, received in U.S. Appl. No. 16/656,930, 11 pages.
Chinese Office Action with English translation issued Oct. 18, 2022, received in Chinese Patent Application No. 202210128813.3, 14 pages.
Australian Examination Report issued Nov. 15, 2022, received in Australian Patent Application No. 2021232679, 5 pages.
Chinese Office Action with English summary issued Nov. 23, 2022, received in Chinese Patent Application No. 201980068818.8, 7 pages.

(56) References Cited

OTHER PUBLICATIONS

Chinese Office Action with English summary issued Dec. 26, 2022, received in Chinese Patent Application No. 202210063972X, 10 pages.
Chinese Second Office Action with English Summary issued May 10, 2023, received in Chinese Patent Application No. 202111186082.X, 17 pages.
Chinese Office Action with machine generated English translation issued May 27, 2023, received in Chinese Patent Application No. 202210128813.3, 19 pages.
Chinese Office Action with English Summary issued Jun. 19, 2023, received in Chinese Patent Application No. 201711405708.5, 10 pages.
Chinese Office Action with English Summary issued Jul. 15, 2023, received in Chinese Patent Application No. 202210063972X, 16 pages.
Australian Examination Report issued Aug. 31, 2023, received in Australian Patent Application No. 2022202981, 4 pages.
Canadian Examiner Report issued Feb. 8, 2021, received in Canada Patent Application No. 3,064,747, 4 pages.
Korean Office Action with English translation issued Mar. 19, 2021, received in Korean Patent Application No. 10-2020-7006909, 15 pages.
Japanese Office Action with English translation mailed Mar. 22, 2021, received in Japanese Patent Application No. 2020-510098, 15 pages.
Chinese Office Action with English translation issued Jan. 6, 2021, received in Chinese Patent Application No. 201711481216.4, 11 pages.
Japanese Office Action with English translation mailed Jan. 26, received in Japanese Patent Application No. 2019-564874, 9 pages.
Chinese Office Action with English translation issued Apr. 13, 2021, received in Chinese Patent Application No. 201810516731.X, 13 pages.
Japanese Office Action with English translation issued Jan. 26, 2021, received in Japanese Patent Application No. 2019-556824, 11 pages.
Chinese Decision of Rejection issued May 7, 2021, received in China Application No. 201680061488.6, 9 pgs.
English translation of Korean Office Action dated May 31, 2019, received in Korean Application No. 10-2018-7014186, 8 pgs.
English translation of Japanese Office Action mailed Dec. 2, 2019, received in JP Application No. 2018-520541, 6 pgs.
English translation of Korean Office Action mailed Nov. 27, 2019, received in Korean Application No. 10-2018-7014180, 5 pgs.
US Office Action mailed Sep. 17, 2019, received in U.S. Appl. No. 15/685,456, 11 pgs.
US Office Action mailed Oct. 23, 2019, received in U.S. Appl. No. 15/492,320, 14 pgs.
Chinese Office Action with English translation issued Jan. 2, 2020, received in Chinese Patent Application No. 201680061488.6, 11 pgs.
English translation of Japanese Decision of Rejection mailed Jan. 6, 2020, received in Japanese Application No. 2017-557189, 5 pgs.
Chinese Office Action with English translation issued Feb. 25, 2020, received in Chinese Patent Application No. 201610921399.6, 18 pgs.
Chinese Office Action with English translation issued Mar. 2, 2020, received in Chinese Patent Application No. 201711481216.4, 16 pgs.
Chinese Office Action with English translation issued Mar. 25, 2020, received in Chinese Patent Application No. 201711405708.5, 11 pgs.
US Office Action mailed Mar. 17, 2020, received in U.S. Appl. No. 15/768,879, 25 pgs.
Australian Examination Report issued Jun. 24, 2021, received in Australian Patent Application No. 2021201452, 6 pages.
Chinese Decision of Rejection with English translation issued Jun. 8, 2021 received in Chinese Patent Application No. 201711405708.5, 6 pages.
Japanese Office Action with English translation mailed Jul. 9, 2021, received in Japanese Patent Application No. 2020-080880, 8 pages.
Korean Office Action with English translation issued Aug. 2, 2021, received in Korean Patent Application No. 10-2020-7006909, 14 pages.
Chinese Office Action with English translation issued Aug. 31, 2021, received in Chinese Patent Application No. 202011084724.0, 8 pages.
European Extended Search Report issued Jul. 13, 2021, received in European Patent Application No. 18848114.7, 5 pages.
Canadian Office Action issued May 3, 2021, received in Canadian Patent Application No. 3,073,677, 6 pages.
Australian Office Action issued May 5, 2021, received in Australian Patent Application No. 2021201726, 3 pages.
Chinese Office Action with English translation issued Dec. 9, 2020, received in Chinese Patent Application No. 201711405708.5, 7 pages.
US Office Action mailed Dec. 16, 2021, received in U.S. Appl. No. 15/492,320, 17 pages.
Korean Office Action with machine translation issued Jan. 18, 2022, received in Korean Patent Application No. 10-2019-7034239, 10 pages.
PCT Search Report and Written Opinion mailed Aug. 23, 2018, received in PCT Application No. PCT/US18/34320, 11 pgs.
PCT Search Report and Written Opinion mailed Jul. 18, 2018, received in PCT Application No. PCT/US18/28635, 16 pgs.
PCT Search Report and Written Opinion mailed Dec. 26, 2018, received in PCT Application No. PCT/US18/47525, 14 pgs.
Australian Examination Report issued Oct. 23, 2018, received in AU Application No. 2016341998, 5 pgs.
Australian Examination Report issued Oct. 16, 2018, received in AU Application No. 2016342001, 5 pgs.
Extended European Search Report issued Mar. 28, 2019, received in EP Application No. 16858305.2, 7 pgs.
English translation of Japanese Office Action mailed May 21, 2019, received in Japanese Application No. 2018-520541, 11 pgs.
English translation of Korean Office Action issued Apr. 30, 2019, received in Korean Application No. 10-2018-7014180, 11 pgs.
US Office Action mailed May 3, 2019, received in U.S. Appl. No. 15/331,045, 9 pgs.
Extended European Search Report issued Apr. 3, 2019, received in EP Application No. 16858308.6, 7 pgs.
English translation of Japanese Office Action mailed Apr. 1, 2019, received in Japanese Application No. 2017-557189, 6 pgs.
US Office Action mailed May 15, 2019, received in U.S. Appl. No. 15/492,320, 13 pgs.
Chinese Office Action with English translation, issued Jul. 31, 2020, received in China Application No. 201610921399.6, 21 pgs.
3rd Party Observation filed Jul. 13, 2020 in EP Application No. 20160744107, 7 pgs.
PCT International Search Report and Written Opinion mailed Mar. 31, 2016, received in corresponding PCT Application No. PCT/US16/15370, 15 pgs.
US Office Action mailed Feb. 22, 2016, received in related U.S. Appl. No. 14/744,438, 29 pgs.
International Search Report and Written Opinion issued on Mar. 17, 2017 in corresponding PCT Patent Application No. PCT/US 16/58155, 12 pgs.
International Search Report and Written Opinion issued on Mar. 24, 2017 in corresponding PCT Patent Application No. PCT/US 16/58148, 14 pgs.
Australian Examination Report issued Nov. 3, 2023, received in Australian Patent Application No. 2021232679, 3 pages.
Australian Examination Report issued Nov. 17, 2023, received in Australian Patent Application No. 2022204276, 3 pages.
Korean Office Action with machine-generated English language translation issued Dec. 6, 2023, received in Korean Patent Application No. 10-2023-7011563, 13 pages.
US Office Action issued on Nov. 30, 2023, received in U.S. Appl. No. 16/921,350, 12 pages.
US Office Action issued Jul. 11, 2024, received in U.S. Appl. No. 18/225,138, 10 pages.

(56) References Cited

OTHER PUBLICATIONS

US Office Action issued Jul. 16, 2024, received in U.S. Appl. No. 18/539,078, 13 pages.
Extended European Search Report dated Aug. 5, 2024, received in European Patent Application No. 23220030.3, 6 pages.
U.S. Office Action issued Jan. 13, 2025, received in U.S. Appl. No. 18/225,138, 10 pages.

* cited by examiner

ROBOTIC CLEANER WITH DUAL CLEANING ROLLERS

CROSS REFERENCE TO RELATED APPLICATIONS

The present application is a continuation of U.S. application Ser. No. 17/556,992 filed Dec. 20, 2021, which is a continuation of U.S. application Ser. No. 15/987,589 filed May 23, 2018, now U.S. Pat. No. 11,202,542, which claims the benefit of U.S. Provisional Patent Application Ser. No. 62/511,099, filed May 25, 2017, all of which are fully incorporated herein by reference. The present application is also related to U.S. patent application Ser. No. 15/492,320 filed Apr. 20, 2017, U.S. patent application Ser. No. 15/331,045 filed Oct. 21, 2016, and International Application No. PCT/US2016/058148 filed on Oct. 21, 2016, all of which are fully incorporated herein by reference.

TECHNICAL FIELD

The present disclosure relates to robotic cleaners and more particularly, to a robotic cleaner with dual cleaning rollers.

BACKGROUND INFORMATION

Robotic cleaners have become an increasingly popular appliance for automated cleaning applications. In particular, robotic vacuum cleaners are used to vacuum surfaces while moving around the surfaces without little or no user interaction. Existing robotic vacuum cleaners include a suction system as well as various cleaning implements and agitators such as rotating brush rolls and side brushes. Similar to manually controlled vacuum cleaners, robotic vacuum cleaners face certain challenges with respect to capturing debris on a surface being cleaned.

Robotic vacuum cleaners generally include a suction conduit with an opening on the underside for drawing air into and through the vacuum cleaner such that debris is captured in the air and deposited in the vacuum cleaner. One of the challenges with vacuum cleaner design is to control engagement of the suction conduit with a surface being cleaned to provide the desired amount of suction. If the suction conduit is spaced too far from a surface, the suction may be less because the air is flowing into the suction conduit through a greater surface area. If the suction conduit is directly engaged with the surface and thus sealed on all sides, air will stop flowing into the suction conduit and the suction motor may be damaged as a result.

Robotic vacuum cleaners also generally use agitation to loosen debris and facilitate capturing the debris in the flow of air into the suction conduit. Agitators are often used in the suction conduit proximate a dirty air inlet to cause the agitated debris to flow into the dirty air inlet. If the agitator in the suction conduit is unable to loosen the debris or if the debris is too small, the suction conduit may pass over the debris without removing the debris from the surface. In other cases, the robotic cleaning apparatus may push larger debris forward without ever allowing the debris to be captured in the flow into the suction conduit (sometimes referred to as snowplowing).

BRIEF DESCRIPTION OF THE DRAWINGS

These and other features and advantages will be better understood by reading the following detailed description, taken together with the drawings wherein.

DETAILED DESCRIPTION

Figure 1:
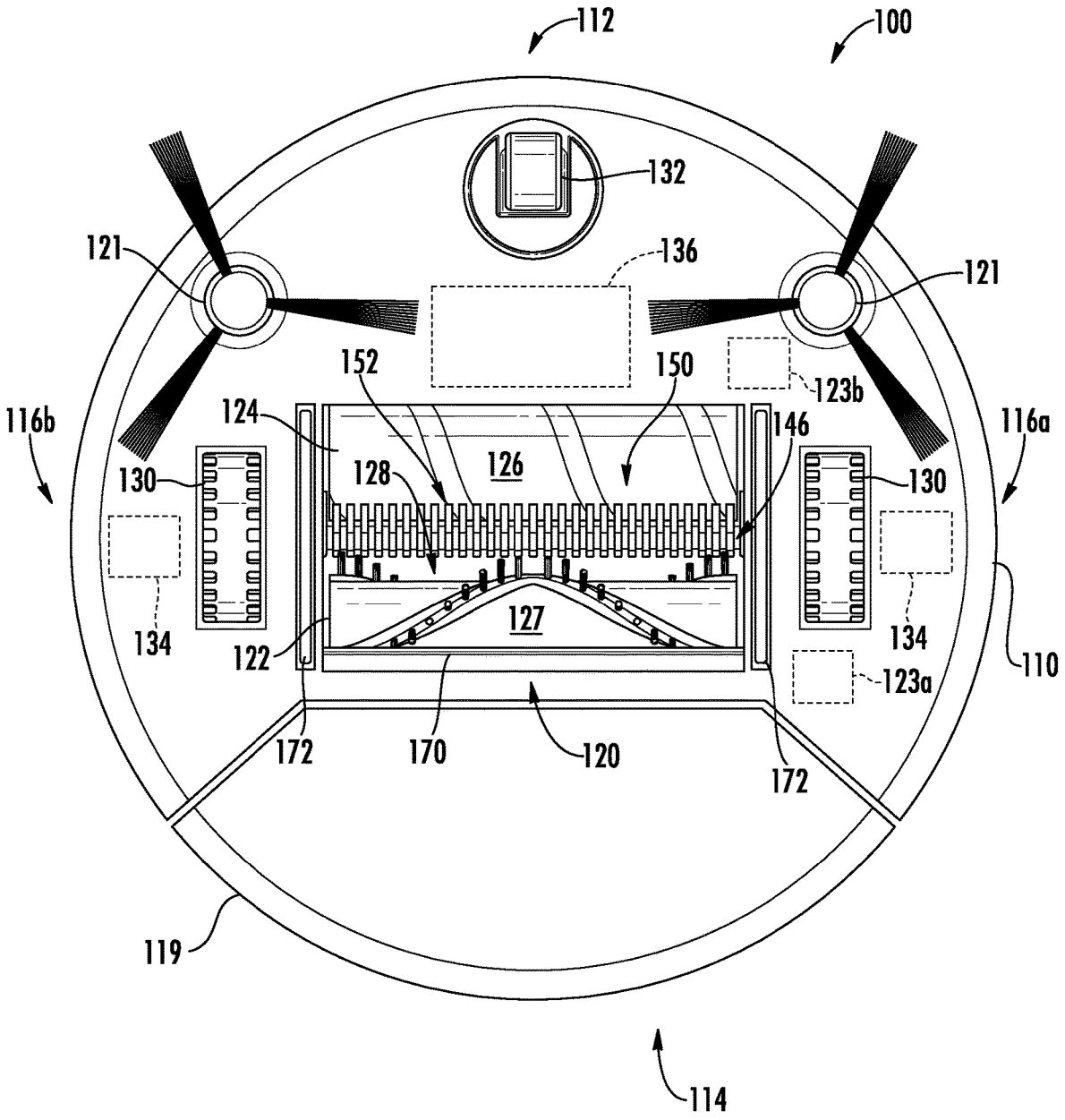
FIG. 1 is a bottom view of a robotic vacuum cleaner including a brush roll and soft roller, consistent with an embodiment of the present disclosure.

A robotic cleaning apparatus, consistent with embodiments of the present disclosure, includes dual cleaning rollers. In some embodiments, the dual cleaning rollers include a soft roller together with a brush roll. In other embodiments, a combing unit including spaced combing protrusions engages one or both of the cleaning rollers to remove debris such as hair, string and the like. In further embodiments, the robotic cleaning apparatus further includes at least one sealing strip along sides of an opening to a suction conduit such that the sealing strips seal the opening together with one of the cleaning rollers. In still further embodiments, the robotic cleaning apparatus includes at least one straight side with one of the cleaning rollers being a leading roller mounted proximate the straight side.

In a robotic cleaning apparatus with a combing unit (also referred to as a debriding unit or rib), consistent with embodiments of the present disclosure, a series of spaced protrusions or teeth extend into one or both of the cleaning rollers for preventing build up and removing debris (such as hair, string, and the like). The protrusions may extend along a substantial portion of the cleaning roller and extend partially into the cleaning roller to intercept the debris as it passes around the roller. The protrusions have angled leading edges that are not aligned with a rotation center of the cleaning roller and are directed into or against a direction of rotation of the cleaning roller. The combing unit and protrusions have a shape and configuration designed to facilitate debris removal from the cleaning roller with minimal impact on the operation of the cleaning apparatus.

In a robotic cleaning apparatus with a leading roller and a brush roll, consistent with embodiments of the present disclosure, the leading roller may be used to facilitate capturing of debris in the air flow into a suction conduit on the underside of the robotic cleaning apparatus. In this embodiment, the leading roller is generally positioned adjacent to and in advance of the opening of the suction conduit such that the leading roller engages debris and moves the debris toward the opening. At least a top half of the leading roller may be substantially outside of the flow path to the suction conduit and a bottom portion of the leading roller may be exposed to the flow path to the suction conduit. The rotating brush roll may be located in the suction conduit with the leading roller located in front of and spaced from the brush roll, forming an inter-roller air passageway between lower portions of the leading roller and the brush roll. In some embodiments, combing protrusions may contact the leading roller above the inter-roller air passageway to facilitate debris removal into the flow path.

Although specific embodiments of a robotic cleaning apparatus with dual cleaning rollers are shown, other embodiments are within the scope of the present disclosure.

As used herein, "seal" or "sealing" refers to preventing a substantial amount of air from passing through to the suction conduit but does not require an air tight seal. As used herein, "agitator" refers to any element, member or structure capable of agitating a surface to facilitate movement of debris into a suction air flow in a cleaning apparatus. As used herein, "soft" and "softer" refer to the characteristics of a cleaning element being more compliant or pliable than another cleaning element. As used herein, the term "flow path" refers to the path taken by air as it flows into a suction conduit when drawn in by suction. As used herein, the terms "above" and "below" are used relative to an orientation of the cleaning apparatus on a surface to be cleaned and the terms "front" and "back" are used relative to a direction that the cleaning apparatus moves on a surface being cleaned during normal cleaning operations (i.e., back to front). As used herein, the term "leading" refers to a position in front of at least another component but does not necessarily mean in front of all other components.

Figure 2:
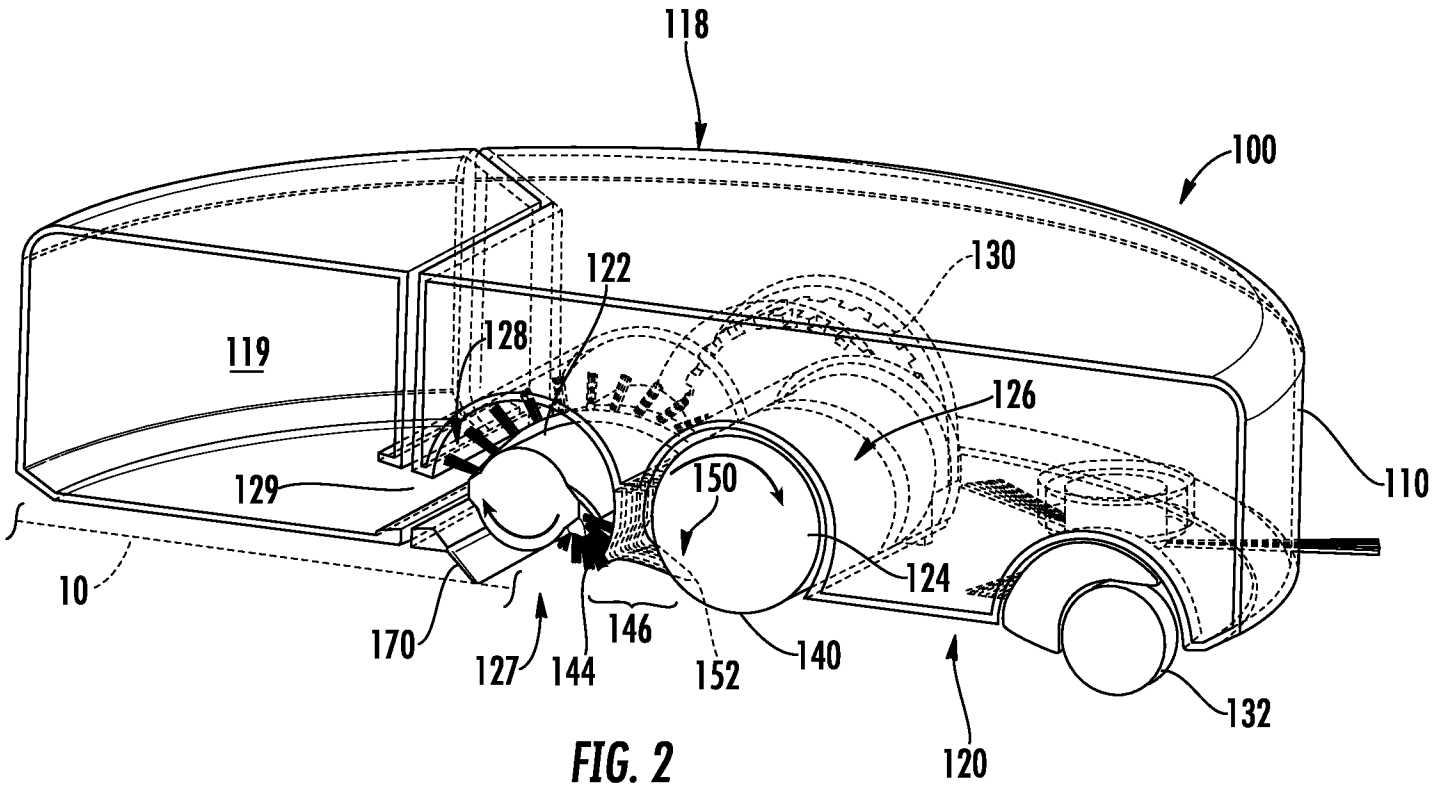
FIG. 2 is a perspective cross-sectional view of the robotic vacuum cleaner shown in FIG. 1.
Figure 3:
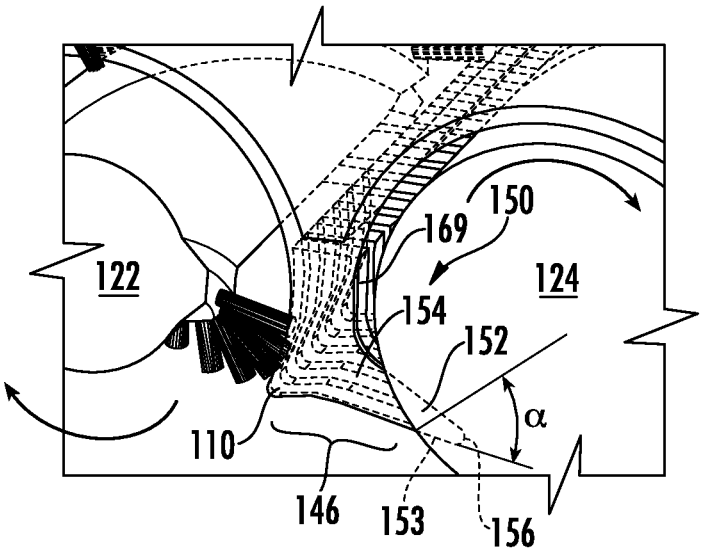
FIG. 3 is an expanded perspective cross-sectional view of a combing unit between the soft roller and brush roll shown in FIG. 2.

Referring to FIGS. 1-3, an embodiment of a robotic cleaning apparatus 100 with dual cleaning rollers is shown and described. The robotic cleaning apparatus 100 includes a housing 110 with a front side 112, and a back side 114, left and right sides 116*a*, 116*b*, an upper side 118, and a lower or under side 120. The housing 110 defines a suction conduit 128 having an opening 127 on the underside 120 of the housing. The suction conduit 128 is fluidly coupled to a dirty air inlet 129, which may lead to a suction motor (not shown) in the robotic cleaning apparatus 100. The suction conduit 128 is the interior space defined by interior walls in the housing 110, which receives and directs air drawn in by suction, and the opening 127 is where the suction conduit 128 meets the underside 120 of the housing 110. The robotic cleaning apparatus 100 further includes a debris collector 119, such as a removable dust bin, located in or integrated with the housing 110, for receiving the debris received through the dirty air inlet 129.

The robotic cleaning apparatus 100 includes dual rotating agitators or cleaning rollers 122, 124, for example, a brush roll 122 and a leading roller 124. The brush roll 122 and leading roller 124 may be configured to rotate about first and second rotating axes. The brush roll 122 rotates to direct debris into the debris collector 119 and the leading roller 124 rotates to direct debris toward the brush roll 122. The rotating brush roll 122 is at least partially disposed within the suction conduit 128. The leading roller 124 is positioned in front of and spaced from the brush roll 122 and at least substantially outside the suction conduit 128. In some embodiments, at least an inside upper portion (e.g., upper half) of the leading roller 124 is not exposed to the primary air flow path into the opening 127 of the suction conduit 128 while at least an inside of the bottom portion of the leading roller 124 is exposed to the primary flow path into the opening 127 of the suction conduit 128.

Other variations are possible where different portions of the leading roller 124 may be exposed or not exposed to the flow path into the suction conduit 128. In other embodiments, for example, a flow path may allow air to flow over the upper portion of the leading roller 124. The leading roller 124 may rotate about the second rotation axis located within a leading roller chamber 126. The leading roller chamber 126 may have a size and shape slightly larger than the cylindrical projection of the leading roller 124 when the leading roller 124 is rotating therein, for example, to form the flow path over the upper portion.

The brush roll 122 and leading roller 124 may be coupled to one or more motors 123*a*, 123*b*, such as AC or DC electrical motors, to impart rotation. The rotating brush roll 122 may be coupled to the electrical motor 123*a* by way of a gears and/or drive belts. The leading roller 124 may be driven from the same drive mechanism (i.e., motor 123*a*) used to drive the rotating brush roll 122 or a separate drive mechanism (i.e., motor 123*b*). An example of the drive mechanism is described in U.S. patent application Ser. No. 15/331,045, filed Oct. 21, 2016, which is incorporated herein by reference. Other drive mechanisms are possible and within the scope of the present disclosure.

In at least one embodiment, the brush roll 122 and the leading roller 124 rotate in the same direction directing debris toward the suction conduit 128, for example, clockwise as shown in FIGS. 2 and 3. This arrangement may reduce the number of parts (e.g., no clutch or additional gear train may be necessary), thereby making the robotic cleaning apparatus 100 lighter, reducing drivetrain loss (thereby allowing for smaller/less expensive motors), and less expensive to manufacture. Optionally, the brush roll 122 and the leading roller 124 may rotate at same speed, thereby reducing the number of parts (e.g., no additional gear train necessary) and reducing drivetrain loss (thus, smaller/less expensive motor) and making the robotic cleaning apparatus 100 lighter and less expensive to manufacture. The robotic cleaning apparatus may also include one or more driven rotating side brushes 121 to sweep debris toward the leading roller 124.

The robotic cleaning apparatus 100 may also include one or more driven wheels 130 and at least one non-driven wheel 132 (e.g., a caster wheel) for supporting the housing on the surface to be cleaned. The driven wheels 130 and the non-driven wheel 132 may provide the primary contact with the surface being cleaned and thus primarily support the robotic cleaning apparatus 100. When the robotic cleaning apparatus 100 is positioned on the surface being cleaned, the leading roller 124 may also rest on the surface being cleaned. In other embodiments, the leading roller 124 may be positioned such that the leading roller 124 sits just above the surface being cleaned. The robotic cleaning apparatus 100 also includes drive motors 134 for driving the drive wheels 130 (e.g., independently). A controller 136 is coupled to at least the drive motors 134 for controlling movement and other functions of the robotic cleaning apparatus 100. The robotic cleaning apparatus 100 may further include sensors (e.g., proximity sensors, bump sensors, cliff sensors) such that the controller 136 operates the drive wheels 134 and other components in response to sensed conditions, for example, according to known techniques in the field of robotic cleaners.

The rotating brush roll 122 may have bristles, fabric, or other cleaning elements, or any combination thereof around the outside of the brush roll 122. Examples of brush rolls and other agitators are shown and described in greater detail in U.S. Pat. No. 9,456,723 and U.S. Patent Application Pub. No. 2016/0220082, which are fully incorporated herein by reference.

The leading roller 124 may include a relatively soft material (e.g., soft bristles, fabric, felt, nap or pile) arranged in a pattern (e.g., a spiral pattern) to facilitate capturing debris, as will be described in greater detail below. The leading roller 124 may be selected to be substantially softer than that of the brush roll 122. The relatively soft material may include, without limitation, thin nylon bristles (e.g., a diameter of 0.04±0.02 mm) or a textile or fabric material, such as felt, or other material having a nap or pile suitable for cleaning a surface. Multiple different types of materials may be used together to provide different cleaning characteristics. A relatively soft material may be used, for example, with a more rigid material such as stiffer bristles (e.g., nylon bristles with a diameter of 0.23±0.02 mm). Materials other than nylon may also be used such as, for example, carbon fibers. The material may be arranged in a pattern around the leading roller 124, such as the spiral pattern shown in FIG. 1, to facilitate movement of debris toward the opening 127 and into the suction conduit 128. The spiral pattern may be formed, for example, by a wider strip of the relatively soft material and a thinner strip of more rigid material. Other patterns may also be used and are within the scope of the present disclosure.

The softness, length, diameter, arrangement, and resiliency of the bristles and/or pile of the leading roller 124 may be selected to form a seal with a hard surface (e.g., but not limited to, a hard wood floor, tile floor, laminate floor, or the like), whereas the bristles of the brush roll 122 may selected to agitate carpet fibers or the like. For example, the leading roller 124 may be at least 25% softer than the brush roll 122, alternatively the leading roller 124 may be at least 30% softer than the brush roll 122, alternatively the leading roller 124 may be at least 35% softer than the brush roll 122, alternatively the leading roller 124 may be at least 40% softer than the brush roll 122, alternatively the leading roller 124 may be at least 50% softer than the brush roll 122, alternatively the leading roller 124 may be at least 60% softer than the brush roll 122. Softness may be determined, for example, based on the pliability of the bristles or pile being used.

The size and shape of the bristles and/or pile may be selected based on the intended application. For example, the leading roller 124 may include bristles and/or pile having a length of between 5 to 15 mm (e.g., 7 to 12 mm) and may have a diameter of 0.01 to 0.04 mm (e.g., 0.01-0.03 mm). According to one embodiment, the bristles and/or pile may have a length of 9 mm and a diameter of 0.02 mm. The bristles and/or pile may have any shape. For example, the bristles and/or pile may be linear, arcuate, and/or may have a compound shape. According to one embodiment, the bristles and/or pile may have a generally U and/or Y shape. The U and/or Y shaped bristles and/or pile may increase the number of points contacting the floor surface 10, thereby enhancing sweeping function of leading roller 124. The bristles and/or pile may be made on any material such as, but not limited to, Nylon 6 or Nylon 6/6.

Optionally, the bristles and/or pile of leading roller 124 may be heat treated, for example, using a post weave heat treatment. The heat treatment may increase the lifespan of the bristles and/or pile of the leading roller 124. For example, after weaving the fibers and cutting the velvet into rolls, the velvet may be rolled up and then run through a steam rich autoclave making the fibers/bristles more resilient fibers.

The leading roller 124 may be positioned within the housing 110 such that the bottom contact surface 140 is disposed closer to the surface to be cleaned compared to the bottom contact surface 144 of the brush roll 122. This arrangement allows the leading roller 124 to contact a surface (e.g., a hard surface) without the brush roll 122 contacting the hard surface. As may be appreciated, the leading roller 124 is intended to pick up debris from a hard surface while the brush roll 122 is intended to primarily contact a carpet surface. This arrangement is therefore beneficial since it allows the leading roller 124 to form a seal between the front 112 of the robotic cleaning apparatus 100 with the hard surface, thereby enhancing airflow and suction with the hard surface. Additionally, this arrangement reduces the drag/torque on the drive motor(s) since the brush roll 122 (in some embodiments) does not have to contact the hard surface. The reduced drag/torque may allow for a smaller, less expensive motor and/or may increase the lifespan of the motor.

According to some embodiments, the leading roller 124 is spaced apart a distance (which is greater than 0 mm) from the brush roll 122 such that the leading roller 124 does not contact the brush roll 122. The distance allows for an inter-roller vacuum passageway 146 between lower portions of the brush roll 122 and the leading roller 124, which provides at least a portion of the flow path into the opening 127 of the suction conduit 128. The inter-roller vacuum passageway 146 allows for debris that is either picked up by (and/or removed from) the leading roller 124 to be entrained in the vacuum flow generated by the robotic cleaning apparatus 100 and/or to be picked up by the brush roll 122, thereby enhancing the cleaning efficiency of the robotic cleaning apparatus 100. Additionally, the distance reduces the load/drag on the motor(s), thereby enhancing the lifespan of the motor(s) and/or allowing smaller motors to be used to rotate both the brush roll 122 and the leading roller 124.

One or both of the leading roller 124 and the brush roll 122 may be removable. The ability to remove the brush roll 122 and/or the leading roller 124 from the robotic cleaning apparatus 100 allows the brush roll 122 and/or the leading roller 124 to be cleaned more easily and may allow the user to change the size of the brush roll 122 and/or the leading roller 124, change type of bristles on the brush roll 122 and/or the leading roller 124, and/or remove the brush roll 122 and/or the leading roller 124 entirely depending on the intended application.

In some embodiments, the robotic cleaning apparatus 100 may also include a combing unit 150 including a series of combing protrusions 152 (also referred to as debriding protrusions) in contact with the leading roller 124. The combing protrusions 152 may be configured to remove debris (such as, but not limited to, hair, string, and the like) that may be wrapped around and/or entrapped/entrained in/on the leading roller 124 as the robotic cleaning apparatus 100 is being used (e.g., without the user having to manually remove the debris from the leading roller 124). According to one embodiment, the combing protrusions 152 may contact only the leading roller 124 (e.g., the combing protrusions 152 may not contact the brush roll 122). Some of the benefits of the combing protrusions 152 only contacting the leading roller 124 include increasing the lifespan of the leading roller 124. Additionally, the combing protrusions 152 that only contact the leading roller 124 may reduce the load/drag on the motor, thereby allowing a smaller/less expensive motor to be used and making the robotic cleaning apparatus 100 lighter and less expensive to manufacture.

The combing protrusions 152 may be disposed at a height above the bottom contacting surface 140 of the leading roller 124 and on a side or lower half of the leading roller 124. The placement of the combing protrusions 152 may help to prevent the combing protrusions 152 from contacting a carpet, thereby reducing drag on the robotic cleaning apparatus 100 and reducing the likelihood of the combing protrusions 152 damaging the carpet. This arrangement also allows the combing protrusions 152 to be exposed to the inter-roller vacuum passageway 146, thereby enhancing the removal of debris from the leading roller 124 by the combing protrusions 152. The combing protrusion 152 may also substantially prevent air from flowing through the combing protrusions 152 to the inside upper portion (e.g., upper half) of the leading roller 124. In other embodiments, a space may be formed between the outer surface of the leading roller 124 and the support such that air flows downward through the combing protrusions 152 to force debris into the air flow through the inter-roller vacuum passageway 146.

As shown in greater detail in FIG. 3, the combing protrusions 152 are teeth extending from a support 169 and extending partially into the cleaning roller 124. Although the illustrated embodiment shows the combing unit 150 with teeth 152 extending from a single support 169, the combing unit 150 may also include teeth 152 extending from multiple supports 169. Examples of the shapes and configurations of combing protrusions 152 are shown in greater detail in U.S. patent application Ser. No. 15/492,320, which is fully incorporated herein by reference. Other shapes and configurations for the combing protrusions 152 are also within the scope of the present disclosure.

The combing unit 150 may extend along a substantial portion of a length of the cleaning roller 124 (i.e., more than half) such that the combing teeth 152 remove debris from a substantial portion of the cleaning surface of the cleaning roller 124. In an embodiment, the combing teeth 152 may engage the cleaning surface of the cleaning roller 124 along, for example, greater than 90% of a length of the cleaning surface of the cleaning roller 124. The combing unit 150 works particularly well with cleaning rollers that are designed to move hair and other similar debris away from a center of the roller 124.

The combing teeth 152 have angled leading edges 153 that are not aligned with a rotation center of the cleaning roller 124. The angled leading edges 153 are the edges that an incoming portion of the rotating cleaning roller 124 hits first and are directed toward or into a direction of rotation of the cleaning roller 124. More specifically, the leading edge 153 of a combing tooth 152 forms an acute angle $\alpha$ relative to a line extending from an intersection point where the leading edge 153 intersects with an outer surface of the cleaning roller 124 to the rotation center. In some embodiments, the angle $\alpha$ is in a range of 5° to 50° and more specifically in a range of 20° to 30° and even more specifically about ° 24 to 25°.

In some embodiments, the combing teeth 152 are positioned as close as possible to the bottom contact point 140 of the cleaning roller 124 but high enough to prevent being caught on a surface being cleaned (e.g., a carpet). The combing teeth 152, for example, may be positioned just above the lowest structure on the housing of a cleaning apparatus. Positioning the combing teeth 152 closer to the bottom contact point 140 of the cleaning roller 124 allows debris to be intercepted and removed as soon as possible, thereby improving debris removal. The combing unit 150 may have other orientations and positions relative to the cleaning roller 124 (e.g., above the rotation center).

The combing teeth 152 may extend into the cleaning roller 124 to a depth in a range of 0% to 50% of the cleaning roller radius for a soft roller (e.g., but not limited to, greater than 0% to 50%) and 0% to 30% of the cleaning roller radius for a tufted brush roll (e.g., but not limited to, greater than 0% to 30%). In one embodiment, the cleaning roller 124 is a soft roller (e.g., nylon bristles with a diameter less than or equal to 0.15 mm and a length greater than 3 mm) and the combing teeth 152 extend into the soft cleaning roller 124 in a range of 15% to 35%. The combing protrusions 152 may be positioned to provide a root gap or spacing between the support 169 and the outer surface of the cleaning roller 124 such that air may flow between the cleaning roller 124 and the support 169 and around and/or through the roots 154 of the combing teeth 152. The air flow around and/or through the roots 154 of the combing teeth 152 may help to dislodge debris that has been removed from the cleaning roller 124 and to direct the debris into an air flow passageway toward a suction conduit of a cleaning apparatus. The root gap may have a width in a range of 1 to 3 mm and more specifically a range of 2 to 3 mm. The root gap may extend across an entire length of the combing unit 150, or a root gap may be formed only in one or more sections along the length of the combing unit 150 to form air channels only at those sections. In other embodiments, the support 169 of the combing unit 150 may contact the outer surface of the cleaning roller 124 to provide sealing and force air to flow under the cleaning roller 124.

In the illustrated embodiment, the combing teeth 152 have a triangular-shaped "tooth" profile with a wider base or root 154 having a root width $W_r$ and a tip 156 having a diameter $D_r$. In general, the base or root 154 may be wide enough to prevent the tooth 152 from bending upward when contacted by the rotating cleaning roller 124 and the tip 156 may be sharp enough to catch the debris. In some embodiments, the tip 156 may be rounded with a diameter in the range of less than 3 mm and more specifically in the range of 1 to 2 mm and even more specifically about 1.6 mm. The root width $W_r$ may be in a range of 5 to 6 mm.

In another embodiment (not shown), combing teeth 152 have a curved profile with curved leading edges forming a concave curve. In this embodiment, a line extending from the curved leading edge at the tip 156 forms an angle $\alpha$ with the line extending from the intersection point to the rotation center. The combing teeth 152 with curved edges may be positioned and spaced similar to the teeth 152 with straight leading edges as described and shown herein.

In some embodiments, the combing unit 150 includes combing teeth 152 spaced 4 to 16 teeth per inch, and more specifically, 7 to 9 teeth per inch. The combing teeth 152 may be made of plastic or metal and may have a thickness that provides a desired rigidity to prevent bending when engaged with the rotating cleaning roller 124. In some embodiments, the combing teeth 152 may have a thickness in a range of 0.5 to 2 mm depending upon the material. In one example, the combing teeth 152 are made of plastic and have a thickness of 0.8 mm, a spacing S of about 2.4 mm, and a center-to-center spacing $S_c$ of about 3.3 mm.

Although the combing unit 150 is shown with combing teeth 152 having an equal spacing, a combing unit 150 may also include teeth 152 with different spacings including, for example, groups of equally spaced teeth and/or teeth 152 with different spacings. The combing unit 150 may include a section at the center of the cleaning roller 124 with no teeth and groups of combing teeth 152 proximate ends of the cleaning roller 124 where the hair and similar debris migrates during rotation. Although the combing unit 150 is shown with teeth 152 having the same shape or tooth profile and dimensions, the combing unit 150 may include teeth 152 of different shapes, profiles dimensions and configurations at different locations along the combing unit 150.

Figure 4:
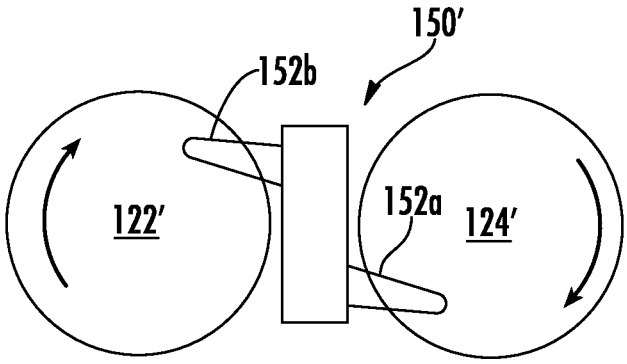
FIG. 4 is a schematic side view of a combing unit engaging dual cleaning rollers, consistent with other embodiments of the present disclosure.

Referring to FIG. 4, another embodiment of a combing unit 150' may include first and second series of protrusions

152*a*, 152*b* engaging both of the cleaning rollers 122', 124' to remove debris from both cleaning rollers. The protrusions 152*a*, 152*b* may be similar to those described above with the leading edge extending into the direction of rotation and not intersecting the rotation center of the respective cleaning rollers 122', 124'. In other embodiments, the first and second series of protrusions 122', 124' may be provided on separate combing units and with different locations.

An embodiment of the robotic cleaning apparatus 100 optionally includes an electrostatic discharge element (ESD). The ESD may reduce and/or prevent the buildup of electrostatic charge on the robotic cleaning apparatus 100. The ESD may include any known device for discharging electrostatic charge. According to one embodiment, the ESD may include Barnet fibers woven between the openings in the back of the leading roller chamber 126. The Barnet fibers may be arranged in close proximity to the combing protrusions 150 and/or leading roller 124 for discharging. For example, the ESD may be connected to a printed circuit board assembly (PCBA) that dumps charge out to the neutral AC line.

In some embodiments, the robotic cleaning apparatus 100 may further include one or more floor sealing strips 170, 172 (FIGS. 1 and 2) on an underside 120 of the housing 110. The floor sealing strip(s) 170, 172 may include one or more sections extending outwardly from the housing 110 and having a length sufficient to at least partially contact the surface 10 (FIG. 2) to be cleaned. The floor seals strip(s) 170, 172 may include soft bristles, fabric material, rubber material, or other material capable of contacting the surface 10 being cleaned to substantially prevent air flow into the opening 127 of the suction conduit 128 from the rear side. The sealing strips 170, 172 may also include a combination of elements or materials, such as bristles with a rubber strip extending along the strip between the bristles (e.g., with the bristles being longer than the rubber strip).

In the example embodiment, a lateral floor sealing strip 170 (FIG. 1) extends along a rear lateral portion (e.g., the longitudinal axis of the lateral floor sealing strip 170 extends generally between the left and right sides 116*a*, 116*b* of the housing 110 behind at least a portion of the opening 127 of the suction conduit 128) and side sealing strips 172 extend along the left and right sides of the opening 127 (e.g., the longitudinal axes of the side sealing strips 172 extend generally between at least a portion of the front and back sides 112, 114 of the housing 110). Because the leading roller 124 itself forms a seal with the surface 10 being cleaned, additional sealing strips are unnecessary along that side of the opening 127 (however, additional sealing strips may be added along that side of the opening 127). Although separate strips 170, 172 are shown, one or more continuous sealing strips may be used (e.g., portions of both the lateral floor sealing strip 170 and one or more of the side sealing strips 172 may be formed by one or more continuous sealing strips). The floor sealing strips 170, 172 may enhance sealing between the robotic cleaning apparatus 100 and the floor, thereby enhancing the vacuum efficiency. In the illustrated embodiment, the lateral floor sealing strip 170 is angled forward in a direction of forward movement of the robotic cleaning apparatus 100. Similarly, one or more of the side sealing strips 172 may also (or alternatively) be angled forward in a direction of forward movement of the robotic cleaning apparatus 100.

Figure 5:
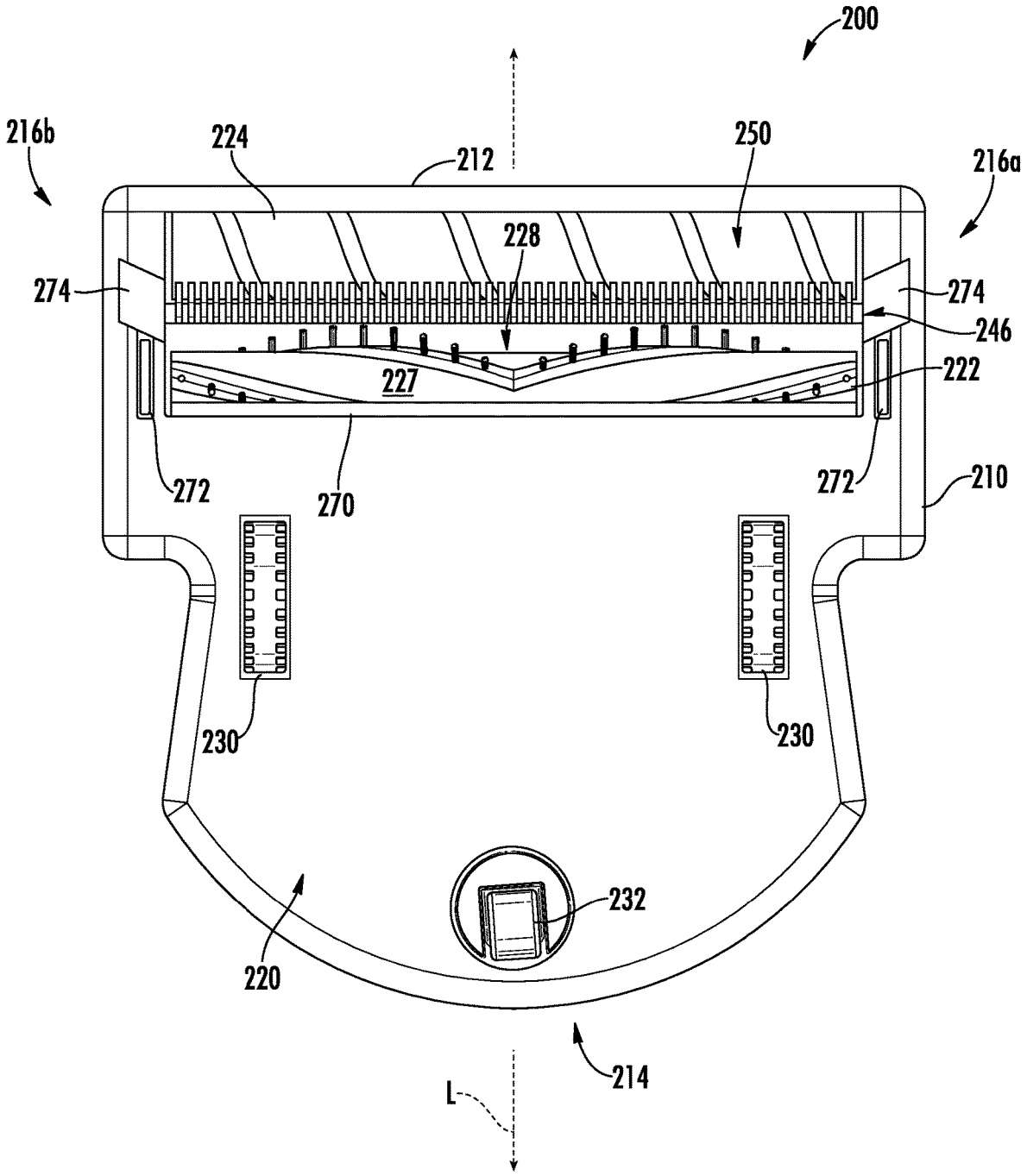
FIG. 5 is a bottom view of a robotic vacuum cleaner including a brush roll and soft roller proximate a leading edge, consistent with another embodiment of the present disclosure.
Figure 6:
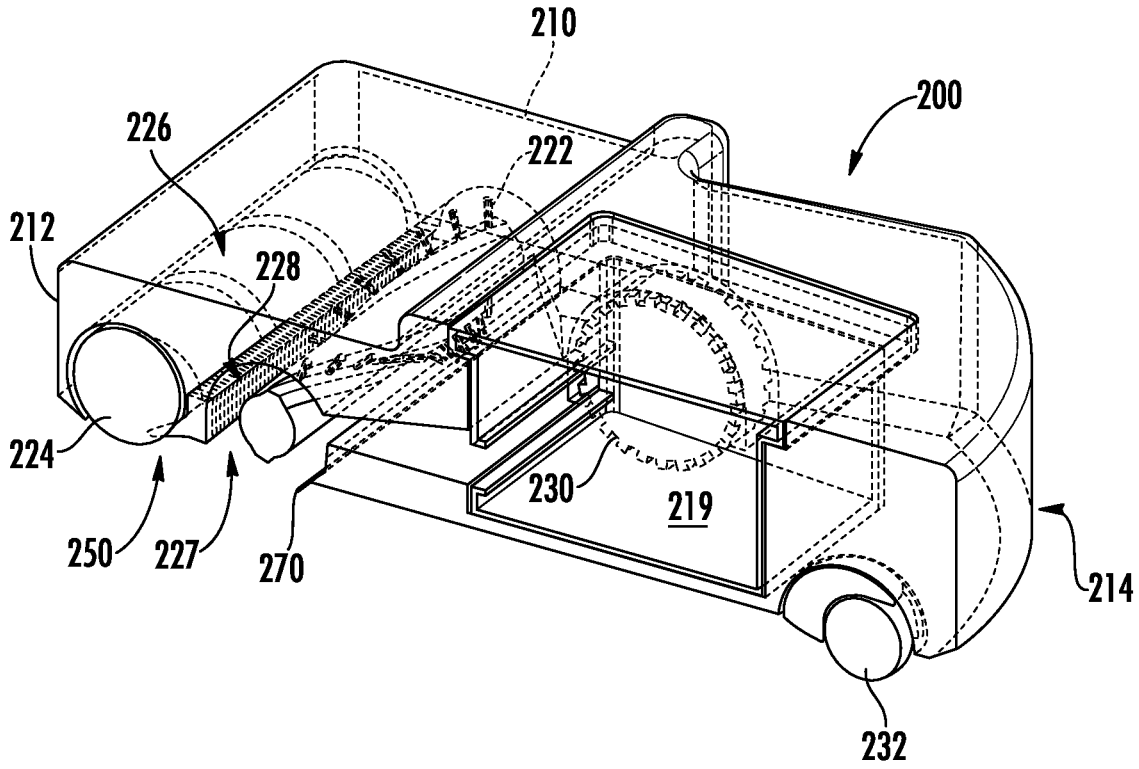
FIG. 6 is a perspective cross-sectional view of the robotic vacuum cleaner shown in FIG. 5.
Figure 7:
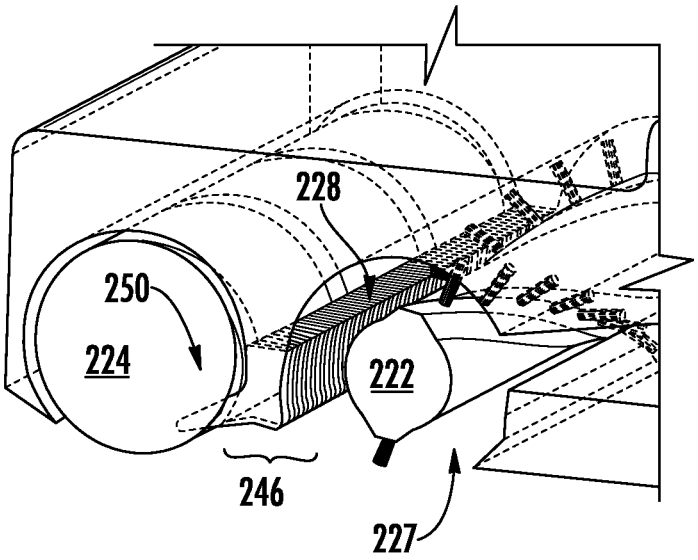
FIG. 7 is an expanded perspective cross-sectional view of a combing unit between the soft roller and brush roll shown in FIG. 6.

Referring to FIGS. 5-7, another embodiment of a robotic cleaning apparatus 200 including dual cleaning rollers 222, 224 is shown and described. The robotic cleaning apparatus 200 includes a housing 210 with a straight front side 212 to facilitate cleaning against a wall. The straight front side 212 is formed by a square shaped front portion of the housing 210, although other shapes are also contemplated and within the scope of the present disclosure. The housing 210 also includes a debris collector 219, such as a removable dust bin, located in or integrated with the housing 210.

Similar to the robotic cleaning apparatus 100 described above, the robotic cleaning apparatus 200 includes dual cleaning rollers 222, 224, a combing unit 250, one or more drive wheels 230 and one or more non-driven wheels 232. In this embodiment, the leading roller 224 is rotatably mounted in the housing 210 proximate the straight front side 212 and the non-driven wheel 232 (e.g., a caster wheel) is rotatably mounted proximate a back side 214 of the housing 210. The rotation axis of the leading roller 224 may be generally parallel to the straight front side 212. The brush roll 222, the leading roller 224, and the combing unit 250 may otherwise be configured as described above.

In this embodiment, a lateral sealing strip 270 extends along a rear lateral portion of the opening 227 to the suction conduit 228 (e.g., the longitudinal axis of the lateral sealing strip 270 extends generally between the left and right sides 216*a*, 216*b* of the housing 210 behind at least a portion of the opening 227 of the suction conduit 228) and side sealing strips 272 extend along a substantial portion of the opening 227 of the suction conduit 228 (e.g., the longitudinal axes of the side sealing strips 272 extend generally between at least a portion of the front and back sides 212, 214 of the housing 210) and are spaced from the leading roller 224 and/or the brush roll 222 to allow air to pass into the suction conduit 228 from the sides.

The robotic cleaning apparatus 200 may include one or more side edge vacuum passageways 274 formed on an underside 220 of the housing 210 and extending back towards the opening 227 of the suction conduit 228. The side edge vacuum passageways 274 may enhance the side edge cleaning efficiency of the robotic cleaning apparatus 200. Side edge vacuum passageways 274 draw in air from the front 212 and the corner/sides 216*a*, 216*b* towards the suction conduit 228, thereby enhancing edge cleaning as well as front cleaning. At least one of the side edge vacuum passageways 274 may also direct air into the inter-roller air passageway 246 between the leading roller 224 and the brush roll 222 to facilitate removal of debris from the leading roller 224. As such, the side edge vacuum passageways 274 and the inter-roller air passageway 246 together provide at least a portion of the primary air flow path into the suction conduit 228.

The side edge vacuum passageways 274 may be arranged at an approximately 45 degree angle with respect the longitudinal axis L of the housing 210. In other embodiments, the angle of the side edge vacuum passageways 274 may be within 30 to 60 degrees with respect the longitudinal axis L of the housing 210. Although the side edge passageways 274 are shown as angled straight passageways, other shapes and configurations (e.g., S shaped or curved) are also possible and within the scope of the present disclosure.

In other embodiments, the housing 210 may further include a bumper (not shown) forming a top part of the straight front side 212 of the housing 210. The bumper may reduce potential damage to either the robotic cleaning apparatus 100 and/or other objects in the environment. A front portion of the leading roller 224 may be exposed at the front side 212 of the housing 210, and the bumper may extend around at least a top of the leading roller 224. In the example embodiment, the bumper includes a lateral portion extending laterally along the front side 212 of the housing 210 and side portions extending downwardly along left and right sides of the front side 212 of the housing 210. The side portions may extend to a point at or below the second rotation axis RA2 of the leading roller. One example of the bumper is disclosed in greater detail in U.S. patent application Ser. No. 15/492,320, which is fully incorporated herein by reference.

The bumper may optionally define one or more front edge vacuum passageways providing at least a portion of the air flow path. The bumper may therefore generally form a seal with a vertical surface (e.g., wall or the like) to improve front edge cleaning. The front edge vacuum passageways may allow for increased airspeed of the air being sucked into the robotic cleaning apparatus 100, thereby enhancing front edge cleaning. The bumper may also include one or more lateral air passageways disposed in the lateral portion, which also allow for increased airflow along the front side 212.

The bumper may also include one or more compression elements (e.g., ribs) disposed on the lateral edge/section. The compression elements allow for increased resiliency and cushioning of the bumper. When the bumper is pushed against the vertical surface, the compression elements contact the surface first and push the bumper locally farther back than the rest of the bumper, thereby forming a gap on either side of the compression elements. The gaps on either side of the compression elements form air paths allowing air to be drawn down in front of the leading roller 224, which may disturb dust and debris so that it can be directed into the air flow path toward the suction conduit.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A robotic cleaner comprising:

a housing with an opening on an underside of the housing;

a debris collector located in the housing for receiving debris;

a first agitator roll rotatably mounted to the housing such that a portion of the first agitator extends below the underside;

a second agitator rotatably mounted in front of the first agitator; and a combing unit disposed at least partially between the first and second agitators, wherein the combing unit includes at least a first series of spaced combing protrusions extending towards the first agitator and a second series of spaced combing protrusions extending towards the second agitator;

wherein the first series of spaced combing protrusions are disposed above the center of rotation of the first agitator and wherein the second series of spaced combing protrusions are disposed below a center of rotation of the second agitator.

2. The robotic cleaner of claim 1, wherein the second agitator includes a cleaning element that is softer than a cleaning element of the first agitator.

3. The robotic cleaner of claim 1, wherein the second series of combing protrusions have angled leading edges that are not aligned with a center of rotation of the second agitator, wherein the angled leading edges are directed into a direction of rotation of the second agitator.

4. The robotic cleaner of claim 1, wherein the second agitator is rotatably mounted in front of the first agitator and spaced from the first agitator to define an inter-roller air passageway between a lower portion of the first agitator and a lower portion of the second agitator, wherein at least an inside of the lower portion of the second agitator is exposed to a flow path to the suction conduit and wherein at least an inside of an upper portion of the second agitator is outside of the flow path to the suction conduit.

5. The robotic cleaner of claim 1, further comprising a bumper forming a top part of the front side of the housing and extending at least laterally, wherein at least a portion of the bumper provides a leading edge in front of the second agitator such that the housing contacts a vertical surface before the second agitator, wherein the bumper defines at least one air passageway through the bumper to allow air to pass when the bumper is positioned against a vertical surface.

6. The robotic cleaner of claim 1, wherein the second series of spaced combing protrusions include spaced combing teeth extending from a back support, wherein the teeth have roots at the back support and tips at an opposite end from the roots, the teeth being wider at the roots than at the tips.

7. The robotic cleaner of claim 3, wherein the angled leading edges form an acute angle relative to a line extending from an intersection point of the angled leading edge and the second agitator to the rotation center of the second agitator, wherein the acute angle is in a range of 5° to 50°.

8. The robotic cleaner of claim 1, wherein the second series of spaced combing protrusions include spaced combing teeth extending from a back support to tips, and wherein at least some of the tips are rounded with a diameter in a range less than 3 mm.

9. The robotic cleaner of claim 1, wherein the second series of spaced combing protrusions include spaced combing teeth extending from a back support to tips, and wherein the teeth engage the second agitator such that a root gap is formed between the back support and an outer portion of the second agitator, wherein the root gap is in a range of 1 to 3 mm.

10. The robotic cleaner of claim 1, wherein the second series of spaced combing protrusions extend into the second agitator about 15% to 35% of a radius of the second agitator.

11. The robotic cleaner of claim 1, wherein an upper portion of the second agitator above the second series of spaced combing protrusions is outside of the suction conduit.

12. The robotic cleaner of claim 1, further comprising:

at least one sealing strip located on the underside of the housing along a rear side of the opening, and wherein the underside of the housing defines side edge vacuum passageways extending from left and right sides of the housing towards the opening of the suction conduit to direct air to the opening.

13. The robotic cleaner of claim 12, wherein the at least one sealing strip further includes left and right side sealing strips extending along left and right sides of the opening, and wherein the side edge vacuum passageways extend between the second agitator and ends of the left and right side sealing strips back towards the opening of the suction conduit.

14. The robotic cleaner of claim 13, wherein the side edge vacuum passageways are defined as recessed portions on the underside of the housing.

15. The robotic cleaner of claim 12, wherein the side edge passageways form an acute angle relative to the left and right sides of the housing.

16. The robotic cleaner of claim 1 further comprising:

at least one sensor;

at least one drive motor;

at least one driven wheel coupled to the at least one drive motor; and a controller coupled to at least one drive motor for controlling movement of the robotic cleaner in response to at least one sensor.

17. The robotic cleaner of claim 4, wherein at least a portion of the combing unit is exposed to the inter-roller air passageway.

18. A robotic cleaner comprising:

a housing with an opening on an underside of the housing;

a debris collector located in the housing for receiving debris;

a first agitator roll rotatably mounted to the housing such that a portion of the first agitator extends below the underside;

a second agitator rotatably mounted in front of the first agitator;

a wall extending downwardly towards the underside and disposed between the first agitator and the second agitator, the wall having a first surface facing the first agitator and a second surface facing the second agitator;

a first series of spaced combing protrusions extending from the first surface of the wall towards the first agitator; and a second series of spaced combing protrusions extending from the second surface of the wall towards the second agitator;

wherein the first series of spaced combing protrusions are disposed above the center of rotation of the first agitator and wherein the second series of spaced combing protrusions are disposed below a center of rotation of the second agitator.

19. A robotic cleaner comprising:

a housing with an opening on an underside of the housing;

a debris collector located in the housing for receiving debris;

a first agitator roll rotatably mounted to the housing such that a portion of the first agitator extends below the underside;

a second agitator rotatably mounted in front of the first agitator;

a wall extending downwardly towards the underside and disposed between the first agitator and the second agitator, the wall having a first surface facing the first agitator and a second surface facing the second agitator;

a first series of spaced combing protrusions extending from the first surface of the wall above a center of rotation of the first agitator towards the first agitator; and a second series of spaced combing protrusions extending from the second surface of the wall below a center of rotation of the second agitator towards the second agitator; and an inter-roller air passageway disposed underneath the wall and extending between a lower portion of the first agitator and a lower portion of the second agitator, wherein at least an inside of the lower portion of the second agitator is exposed to a flow path to the suction conduit and wherein at least an inside of an upper portion of the second agitator is outside of the flow path to the suction conduit.

* * * * *